US005411376A

United States Patent [19]

Fournier et al.

[11] Patent Number: 5,411,376

[45] Date of Patent: May 2, 1995

[54] FUEL PUMP WITH NOISE SUPPRESSION

[75] Inventors: Kirk D. Fournier, Essexville; Ronald B. Kuenzli, Deford; Charles H. Tuckey, Cass City, all of Mich.

[73] Assignee: Walbro Corporation, Cass City, Mich.

[21] Appl. No.: 167,743

[22] Filed: Dec. 15, 1993

[51] Int. Cl.[6] ..... F04B 53/00

[52] U.S. Cl. ..... 417/312; 417/410.4; 417/541

[58] Field of Search ..... 417/312, 313, 410 C, 417/541–543, 423.12; 418/166, 171, 181

[56] References Cited

U.S. PATENT DOCUMENTS

| | | | |
|---|---|---|---|
| 862,867 | 8/1907 | Eggleston | 417/472 |
| 3,801,231 | 4/1974 | Nusser et al. | 417/410 C |
| 4,500,270 | 2/1985 | Tuckey | 418/166 |
| 4,619,588 | 10/1986 | Moore, III | 417/410 C |
| 4,642,030 | 2/1987 | Friebe et al. | 417/203 |
| 4,645,430 | 2/1987 | Carleton | 418/171 |
| 5,013,221 | 5/1991 | Tuckey | 417/423.12 |
| 5,122,039 | 6/1992 | Tuckey | 417/542 |
| 5,219,277 | 6/1993 | Tuckey | 417/541 |

FOREIGN PATENT DOCUMENTS

| | | | |
|---|---|---|---|
| 52588 | 5/1981 | Japan | 417/312 |
| 164060 | 6/1993 | Japan | 418/171 |

*Primary Examiner*—Richard A. Bertsch
*Assistant Examiner*—Peter Korytnyk
*Attorney, Agent, or Firm*—Barnes, Kisselle, Raisch, Choate, Whittemore & Hulbert

[57] ABSTRACT

A gear rotor fuel pump having a gear rotor pump assembly received on a cantilever bearing in an end cap of the pump and an armature journalled for rotation at one end in the bearing while being rotatably unsupported at its other end for preventing bearing misalignment and reducing pump noise. The end cap preferably carries a bellows modulator for reducing pump noise by reducing the amplitude of fuel pressure pulses transmitted to the bellows from the pump assembly through a port in the end cap. To further reduce noise, the end cap preferably has at least one cavity for receiving compressible gas therein to further absorb the pressure pulses as well as noise generated by turbulent fuel flow at a pump inlet. Preferably, the end cap has an interior locator surface which abuts the pump assembly and a locator groove which are both preferably machined relative to the bearing axis so that the pump assembly and armature are accurately axially and radially located in the pump to reduce pump noise while increasing performance, reliability, accuracy and repeatability in the mass production of the pump.

21 Claims, 1 Drawing Sheet

FUEL PUMP WITH NOISE SUPPRESSION

FIELD OF THE INVENTION

This invention relates to fuel pumps and more particularly to a pump of unitary construction for suppressing noise in automotive vehicle fuel systems and the like.

BACKGROUND OF THE INVENTION

Electrically driven, self-contained in-tank gear rotor fuel pumps have been used for delivering fuel from a supply tank to an internal combustion engine of a motor vehicle. This type of pump produces a steady, non-surging, highly pressurized flow of fuel making it ideal for use with modern fuel injection systems. The design is also highly tolerant of fuel supply line pressure transients commonly associated with the abrupt opening and closing of individual fuel injectors.

Typically, these pumps consist of a housing having an electric motor with an armature journalled for rotation between a pair of end caps and coupled to a gear rotor pump assembly. The armature is carried by a shaft received at one end in a bearing in one end cap and at its other end in a bearing in the other end cap. Such a pump is disclosed in U.S. Pat. No. 5,122,039 which is assigned to the assignee hereof.

A problem with these pumps is that they can be noisy during operation which can be objectionable to vehicle occupants. For example, undesirable pump noise can be created by the mechanical interaction of moving parts within the housing during pump operation. Even worse, should the bearings be misaligned when the end caps are assembled to the housing, the armature can become dynamically unbalanced about its axis of rotation and the gear rotor assembly can be slightly radially and/or axially mislocated within the housing dramatically increasing pump noise.

Not only can bearing misalignment contribute to pump noise, it can also adversely affect performance. For example, should the armature be misaligned relative to the stator of the electric motor causing the spacing between the armature and stator to undesirably vary, motor performance can be detrimentally affected. Similarly, if misalignment affects the spacing between the gear rotor pump assembly and the interior surface of the inlet end cap, the maximum volumetric flow rate of the pump assembly can also be reduced. In combination, both of these problems caused by bearing misalignment can seriously degrade pump performance. Unfortunately, the difficulty of repeatedly manufacturing a large number of pumps of this construction having a motor assembly which is consistently properly aligned makes these misalignment problems common.

Another problem with these fuel pumps is noise contributed due to pressure pulses created by fuel being expelled from the pump assembly under high pressure and turbulence in the flow of fuel entering the pump inlet. Although the pressure pulse damper of the gear rotor-type fuel pump disclosed in the aforementioned patent has enjoyed substantial commercial acceptance and success in reducing fuel pump noise, particularly by dampening fuel pressure pulses, improvements nonetheless remain desirable. A pump utilizing such a damper requires a cavity within the pump downstream of the gear rotor pump assembly, increasing the length and number of parts of the pump. Also, the reliability and useful life of these flexible plastic dampers is highly dependent upon its design geometry and cyclical loading which requires careful design and control of part geometry and quality to obtain a reliable damper having an extended service life.

SUMMARY OF THE INVENTION

A gear rotor pump having a housing with an end cap at its outlet end and an end cap at its inlet end. The pump has a gear rotor pump assembly received within the housing operably connected to a motor by an armature journalled for rotation at one end in a cantilever-type bearing received in the inlet end cap and is rotatably unsupported at its other end for preventing bearing misalignment and associated wear and pump noise while increasing pump performance. Preferably, a bellows-type pressure pulse modulator is received within an inlet cover attached to the housing overlying the inlet end cap and captured by a spring between the end cap and the cover for reducing the amplitude of fuel pressure pulses transmitted from the pump assembly through a communications passage in the inlet end cap to the bellows for reducing pump noise. To further reduce pump noise, the exterior surface of the inlet end cap preferably has at least one cavity with compressible gas trapped in each cavity for absorbing noise caused by turbulently flowing fuel entering an inlet port in the end cap while further reducing the amplitude of remaining fuel pressure pulses.

The cantilever bearing is received in a bore in the inlet end cap and preferably rotatably supports a shaft extending from the armature substantially along its entire axial length, thus eliminating the need for bearing support at both ends of the armature and preventing bearing misalignment. The inlet end cap has a locator groove about the periphery of its interior surface for being matingly received in a complementary counterbore in the pump housing. To accurately, axially align and radially position the armature and pump assembly within the housing to decrease wear and noise while increasing pump performance and reliability, an interior surface of the inlet end cap and an axial surface of the locator groove are preferably substantially perpendicular to the longitudinal axis of the cantilever bearing while a radial surface of the locator groove is preferably substantially parallel to the bearing axis. When constructing the inlet end cap, the cantilever bearing is preferably first inserted into the bore and is used as a datum to preferably machine the interior surface of the end cap and each surface of the locator groove for providing an end cap and bearing assembly of unitary construction and highly repeatable accuracy in mass production manufacturing operations.

When assembled to the pump housing, the interior end cap surface serves as a locator surface to enable the pump assembly to be slidably, rotatably received flush against it when the assembly is mounted over the cantilever bearing to increase pump performance and reduce mechanical noise. The axial groove surface of the end cap limits the depth of insertion of the inlet end cap into the pump housing for properly axially locating the pump assembly and armature within the housing. The radial groove surface preferably sealingly, frictionally bears against the inner radial surface of the housing to accurately radially locate the pump assembly and armature within the housing.

Objects, features and advantages of this invention are to provide a gear rotor fuel pump which requires bearing support at only one end of the armature of the pump motor to eliminate bearing misalignment, reduces pump noise and component wear while improving pump performance; provides an end cap construction which axially aligns and radially locates the gear rotor pump assembly and armature within the pump housing to provide an assembly which operates more smoothly for reducing pump noise and increasing reliability and is of highly repeatable manufacture for consistent production in mass quantity on an assembly line; reduces pump noise created by pressure pules transmitted by fuel under pressure exiting the pump assembly; reduces noise created by turbulently flowing fuel entering the pump inlet; and is of compact, unitary construction and is rugged, durable, of simple design, of economical manufacture and easy to assemble and use.

BRIEF DESCRIPTION OF THE DRAWINGS

These and other objects, features, and advantages of this invention will be apparent from the following detailed description of the preferred embodiment and best mode, appended claims, and accompanying drawings in which:

DETAILED DESCRIPTION

Figure 1:
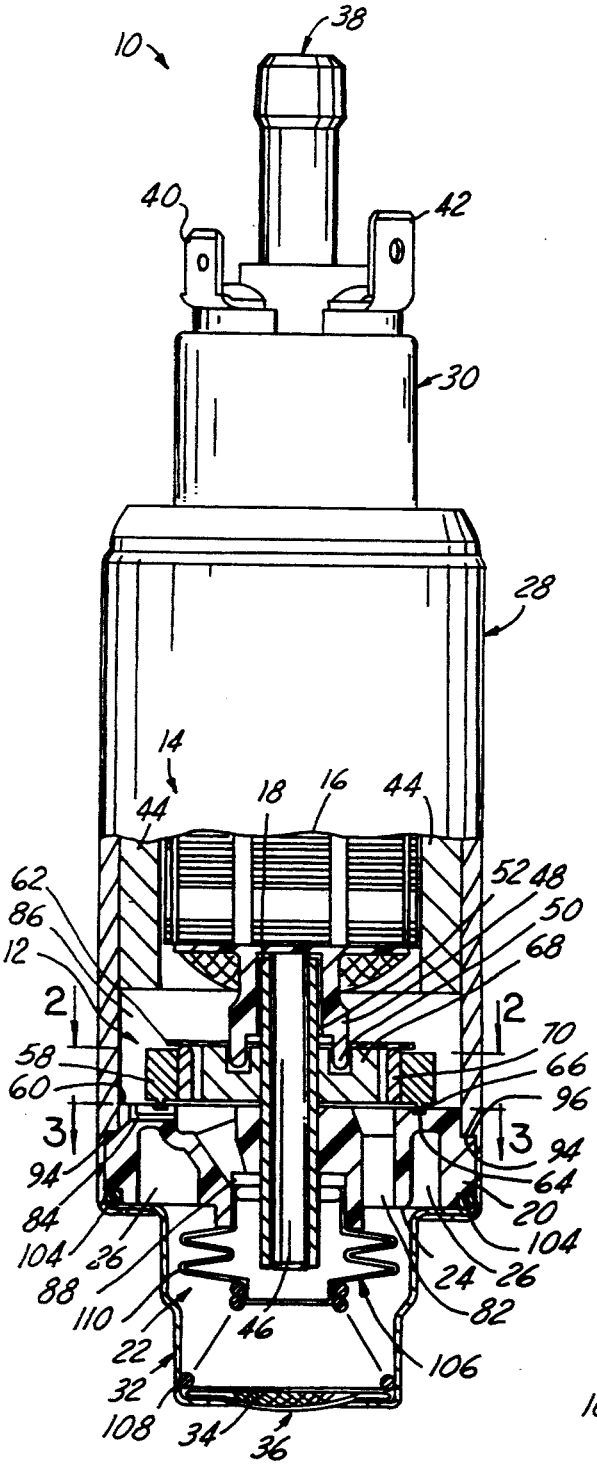
FIG. 1 is a partial sectional side view of a self-contained fuel pump having an armature within the pump rotatably supported by a cantilever bearing in accordance with a presently preferred embodiment of this invention.

FIGS. 1-4 illustrate a gear rotor fuel pump 10 of unitary construction for delivering fuel under high pressure from a supply tank to an internal combustion engine. The fuel pump 10 has a gear rotor pump assembly 12 and an electric motor 14 with an armature 16 journalled for rotation in a generally cylindrical, hollow cantilever-type bearing 18 extending from an inlet end cap 20 secured to the pump 10 and embodying this invention for preventing pump noise by virtually eliminating bearing misalignment. Preferably, the inlet end cap 20 carries a pressure pulse modulator 22 that communicates with the pump assembly 12 for modulating and absorbing pressure pulses transmitted by fuel expelled under high pressure from the pump assembly 12 during operation to reduce noise. Preferably, an exterior surface 24 of the inlet end cap 20 has at least one cavity 26, and preferably a plurality of cavities 26, for receiving a compressible gas therein to absorb and further reduce pump noise.

Referring more particularly to FIG. 1, the pump 10 has a generally cylindrical housing 28 with an outlet end cap 30 at one end and the inlet end cap 20 at its opposite end. Attached to the inlet end of the housing and overlying the inlet end cap 20, is an inlet cover 32 having a filter 34 received in its inlet opening 36 for preventing particulate matter from entering and damaging the pump 10. The outlet end cap 30 is of unitary construction having an outlet nipple 38 extending outwardly therefrom which is in communication with the interior of the pump housing 28 to enable passage of fuel expelled from the pump assembly 12 out of the pump 10. To supply electrical power to the motor armature 16, the outlet end cap 30 has a pair of spaced-apart electrical terminals 40 and 42.

The pump motor 14 is received within the housing 28 with its armature 16 generally encircled by a stator 44. The armature 16 has a shaft 46 extending axially outwardly from one end which is received in the hollow cantilever bearing 18 rotatably supporting the armature 16 without requiring bearing support at its opposite end for preventing bearing misalignment and associated pump noise while increasing the reliability of the pump and motor assemblies 12 & 14. Coaxial with the armature shaft 46 is a hollow, generally cylindrical drive tube 48 that extends from the armature 16 and is generally received over the cantilever bearing 18. The drive tube 48 has a pair of spaced-apart fingers or dogs 50 at its free end which are in operable communication with the pump assembly 12 for rotatably driving the assembly 12 during pump operation. To provide clearance between the drive tube 48 and the cantilever bearing 18 during operation, the inner radial surface of the tube 48 is preferably radially outwardly spaced from the outer radial surface of the bearing 18 creating a circumferential gap 52 therebetween. To prevent contaminants from entering this gap 52, a seal washer 54 is received over the bearing 18 and disposed in a circumferential groove 56 in the tube 48 between the outer axial edge of the tube 48 and the pump assembly 12.

Figure 2:
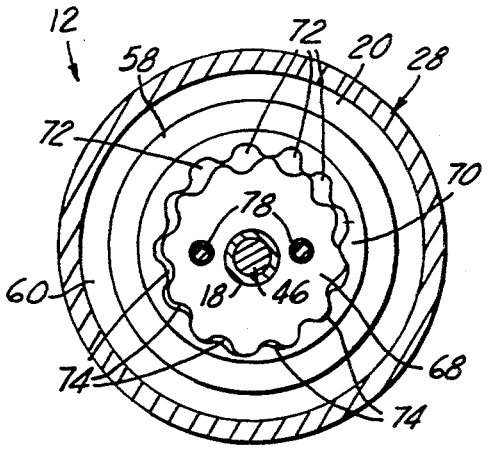
FIG. 2 is a sectional view taken substantially along the line 2—2 in FIG. 1.
Figure 3:
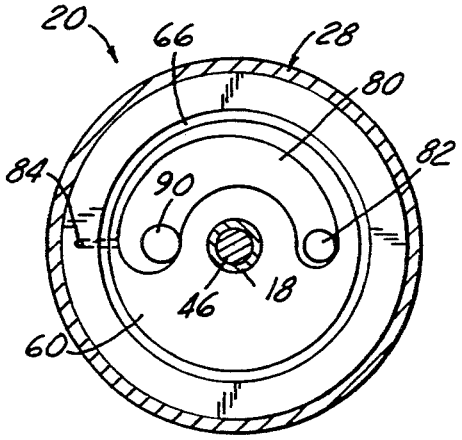
FIG. 3 is a sectional view taken substantially along the line 3—3 in FIG. 1.

Referring additionally to FIGS. 2 and 3, the pump assembly 12 has a pumping chamber defined by a generally cylindrical, hollow cam ring 58 secured to an interior locator surface 60 of the inlet end cap 20 with a sealing disc 62 received over the dogs 50 of the drive tube 48 which seals against the outer axial surface of the cam ring 58, To properly locate the cam ring 58 generally eccentric to the longitudinal axis of the bearing 18, the ring 58 has a mounting flange 64 extending axially outwardly from one end which is received in a complementary channel 66 in the interior surface 60 of the end cap 20. To secure the cam ring 58 to the end cap 20, the mounting flange 64 is preferably ultrasonically welded to the end cap 20, as opposed to joining together the two components, 20 & 58, using mechanical fasteners, for better securing together the two components to reduce noise while increasing the durability of the pump assembly 12. Preferably, the flange 64 is preferably continuously welded to the end cap 20 about the periphery of the cam ring 58 to-prevent leakage of fuel between the ring 58 and end cap 20 to improve performance of the fuel pump 10.

As is shown more clearly in FIG. 2, encompassed by the cam ring 58 within the pump chamber, is an inner gear rotor 68 and a complementary outer gear rotor 70 having intermeshing teeth that define circumferentially disposed enlarging 72 and ensmalling 74 pumping chambers between the rotors 68 & 70. The inner gear rotor 68 has a centrally located bore 76 for slidably, rotatably receiving the bearing 18 through the bore 76 to radially locate the inner rotor 68 and the outer rotor 70 within the cam ring 58, with the outer rotor 70 urged into intermeshing engagement with the inner rotor 68 by the cam ring 58. To operably connect the inner gear rotor 68 to the motor 14 for rotation in unison with the armature 16, the rotor 68 has a pair of spaced-apart openings 78 (FIG. 1), with each bore 78 receiving a dog 50 of the drive tube 48 therein. As the armature 16 rotates during pump operation, the inner and outer gear rotors, 68 & 70, also rotate causing liquid fuel from the supply tank to be drawn into the enlarging pumping chambers 72 and expelled under high pressure from the ensmalling chambers 74 where it passes through the pump housing 28 and out the outlet nipple 38.

Figure 4:
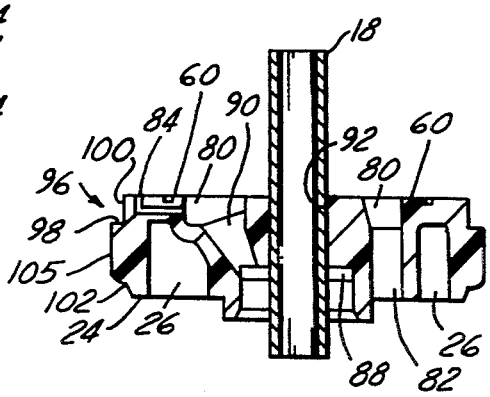
FIG. 4 is a fragmentary sectional view of the inlet and cantilever bearing assembly of FIG. 1 taken substantially through its centerline.

As is shown more clearly in FIGS. 3 and 4, the inlet end cap 20 has a curved channel 80 in its interior surface 60 with an inlet port 82 at one end of the channel 80 that extends completely through the cap 20 to communicate with the supply tank so that fuel can enter the enlarging pumping chambers 72 during pump operation. Spaced from the inlet port 82 at the opposite end of the channel 80, the end cap 20 has a generally radially outwardly extending outlet port 84 for transporting fuel expelled from the ensmalling pumping chambers 74 (FIG. 2) into a cavity 86 within the pump housing 28 where it passes around the armature 16 and exits out the outlet nipple 38. Preferably, the inlet end cap 20 has a through-passage 90 which opens into the channel 80 adjacent the outlet port 84 for communicating to the pressure pulse modulator 22 pressure pulses transmitted by fuel as it is expelled in a pulsating manner from the ensmalling pumping chambers 74 to dampen these pulses and reduce pump noise. To position and retain the pulse modulator 22 generally overlying the communication port 90, the end cap 20 has a circular recess 88 for receiving one end of the modulator 22 therein.

To reduce pump noise created by turbulence in fuel entering the inlet port 82 while also further reducing the amplitude of any remaining pressure pulses, the cavities 26 in the exterior surface 24 of the inlet end cap 20 are preferably spaced about the periphery of the cap 20. Each cavity 26 preferably contains a compressible gas, such as air and/or fuel vapor, trapped by liquid fuel from the supply tank for compressibly absorbing noise created by the turbulent fuel flow at the inlet port 82 and fuel pressure pulses transmitted through the communications passage 90 that were not completely dampened by the modulator 22.

The cantilever bearing 18 is received in a centrally located bore 92 in the inlet end cap 20. Preferably, the diameter of the bore 92 provides an interference fit between the cap 20 and bearing 18 for positively securing it to the cap 20 to provide a cap 20 and bearing 18 of unitary construction. The bearing 18 is of generally cylindrical, hollow construction for receiving the armature shaft 46 therein and is preferably constructed of a high carbon steel which is preferably heat treated to provide a bearing 18 that is durable, long lasting and highly wear resistant.

The bearing 18 is preferably at least substantially the length of that portion of the armature shaft 46 extending axially outwardly from the armature 16, as is shown in FIG. 1, for providing rotative bearing support to the shaft 46 substantially along its entire axial length so that a bearing is not needed at both ends of the armature 16 as is done in gear rotor fuel pumps of conventional construction, such as is disclosed in U.S. Pat. No. 5,122,039. In providing the cantilever bearing 18 to obviate the need for bearing support at each end of the armature, bearing misalignment problems commonly associated with conventional gear rotor pumps are eliminated preventing the armature 16 from becoming dynamically unbalanced when rotating at high speed during pump operation which significantly improves smoothness of operation and reliability while dramatically reducing pump noise.

The inlet end cap 20 is of generally circular cross-sectional construction for being received in a complementary counterbore 94 in the inlet end of the pump housing 28. To accurately, axially and radially position the end cap 20 within the housing 28, the interior surface 60 of the end cap 20 has a locator shoulder or groove 96 about its periphery for matingly engaging the pump housing 28 when the cap 20 is assembled thereto. Preferably, the locator groove 96 has an axial surface 98 that is substantially perpendicular to the longitudinal axis of the cantilever bearing 18 for abutting flush against a complementary axial surface of the counterbore 94 to limit depth of insertion while accurately axially locating the bearing 18, gear rotors 68 & 70 and motor armature 16 within the pump housing 28. To accurately locate the end cap 20 coaxial with housing 28 for properly radially locating the bearing 18, cam ring 58, gear rotors, 68 & 70, and armature 16 within the housing 28, the shoulder or groove 96 has a radial surface 100 that is substantially parallel to the longitudinal axis of the bearing 18. The exterior surface 24 of the end cap 20 also has a shoulder or groove 102 about its periphery for receiving an O-ring 104 (FIG. 1) to provide a fluid-tight seal between the end cap 20 and housing 28 when the cap 20 is received in the housing 28 and the inlet end of the housing 28 is crimped around the end cap 20 during assembly. The surfaces 100 and 105 are also essentially concentric with the axis of the bearing 18.

Referring once again to FIG. 1, the pulse modulator 22 has a bellows 106 housed within the inlet cover 32 with one end generally coaxially received over the bearing 18 and seated within the recess 88 in the end cover 20 so that the modulator 22 communicates with passage 90 for receiving and dampening pressure pulses transmitted from fuel expelled from the pump assembly 12. The bellows 106 is captured within the inlet cover 32 by a coil spring 108 disposed between the inlet cover 32 and the opposite end of the bellows 106 for yieldably biasing the bellows 106 against the end cap 20 to absorb and dampen pressure pulses. Preferably, the bellows 106 has at least two collapsible folds 110 to enable the bellows 106 to flex during its operation to absorb pressure pulses and is constructed of a durable, flexible, resilient material that is impervious to gasoline and alcohol, such as Acetel, for reducing the amplitude of the pressure pulses, thereby reducing pump noise.

In the construction and manufacture of the inlet end cap 20, the bore 92 is preferably drilled completely through the end cap 20 for accurately centrally locating the cantilever bearing 18 in the cap 20 and the bearing 18 is inserted into the bore 92. However, if desired, the bore 92 can be integrally molded in the end cap 20. Referencing the bearing 18 as a datum, the interior locator surface 60 of the cap 20 is preferably machined substantially perpendicular to the longitudinal axis of the bearing 18 so that the gear rotors 68 & 70 abut flush against the interior end cap surface 60 when the inner rotor 68 is received over the bearing 18 during assembly to provide an improved seal between the enlarging and ensmalling pumping chambers, 72 & 74, and the end cap 20 for increasing pump performance and efficiency. Also preferably referencing the bearing 18 as a datum, the radial surface 98 of the locator groove 96 is preferably machined substantially perpendicular to the longitudinal axis of the bearing 18 and the axial surface 100 of the groove 96 and the surface 105 are preferably machined substantially parallel to the longitudinal axis of the bearing 18. In this manner, the inlet end cap 20 and bearing 18 provide a unitary assembly which can be constructed in mass quantity on an assembly line with a high degree of accuracy and repeatability to produce pumps 10 each having the armature 16, cam ring 58 and gear rotors, 68 & 70, accurately axially and radially located within the housing 28 for consistent pump-to-pump performance and reduced pump noise.

In use, the pump 10 is received in an in-tank fuel pump module (not shown) in the fuel supply tank. Preferably, the pump 10 is vertically oriented in the pump module with its inlet opening 36 and inlet port 82 both immersed in liquid fuel within the module so that compressible gas is trapped within the cavities 26 in the end cap 20 by the fuel.

In operation, as the pump motor 14 is energized, the armature 16 begins to rotate, causing the gear rotors 68 & 70 to draw fuel into the pump 10 through the inlet port 82 and expel the fuel out the pump outlet 38. As a result of the construction of the inlet end cap 20 and cantilever bearing 18 enabling accurate location of the moving components within the pump housing 28, namely, the armature 16, cam ring 58, and gear rotors 68 & 70, pump noise caused by mechanical interaction between these components is greatly reduced.

Fuel drawn into each enlarging pumping chamber 72 is carried circumferentially by the rotors 68 & 70 and forcibly expelled from the ensmalling chambers 74 as the gaps between the teeth of each gear rotor narrow during rotation, pulsing the pressurized fuel through the outlet port 84 in the end cap 20 and into the cavity 86 in the pump housing 28. A considerable amount of the energy in these pressure pulses, which ordinarily would have propagated through the pump 10 to the exterior of the pump 10 causing noise, is greatly dissipated as it is channeled by the communications passage 90 from the end cap outlet port 84 to the bellows 106 where it is dampened. As these pulses enter the bellows 106, the folds 110 of the bellows 106 and the coil spring 108 resiliently flex to resist further propagation, thereby absorbing and dampening the pulses greatly reducing their amplitude.

The remaining energy in these pulses, as well as pressure fluctuations created by the turbulent flow of fuel entering the pump inlet port 82, is dissipated considerably by the compressible gas within the end cap cavities 26 acting as a cushion to absorb the energy and further reduce pump noise. As a result, pump noise is dramatically reduced, enabling the pump 10 to be positioned within the fuel supply tank closer to the vehicle occupants without any pump noise disturbing them.

What is claimed is:

1. A gear rotor pump comprising: an inner and an outer gear rotor having intermeshing teeth that define circumferentially disposed enlarging and ensmalling pumping chambers, an inlet end of the pump having spaced fluid inlet and outlet ports opening between said rotors into said enlarging and ensmalling chambers, respectively, a cantilever bearing received in said inlet end of the pump, and an electric motor having an armature with a shaft journalled for rotation and rotatably supported at only one end about its axis of rotation by said cantilever bearing and the armature being rotatably unsupported at its other end, and said armature being connected with at least one of said gear rotors for rotating them.

2. The gear rotor pump of claim 1 also comprising a shaft extending from said armature and received in said cantilever bearing with said cantilever bearing rotatably supporting said armature substantially along the length of said shaft extending from said armature.

3. The gear rotor pump of claim 2 wherein said cantilever bearing is of hollow, generally cylindrical construction for receiving said shaft of said armature therein and is constructed of hardened steel for durability.

4. The gear rotor pump of claim 1 also comprising a pressure pulse modulator carried by said inlet end of the pump and having a bellows cooperating with a spring and said bellows in communication with said outlet port in said inlet end of the pump to modulate and dampen pressure pulses transmitted by fuel as it is expelled out said ensmalling pumping chambers of said rotors for reducing pump noise.

5. The gear rotor pump of claim 4 also comprising a passage in said inlet end of the pump in communication with said outlet port and said bellows for transmitting said pressure pulses to said bellows from fuel being expelled from said rotors for reducing pump noise.

6. The gear rotor pump of claim 1 also comprising a cam ring carried by said inlet end of the pump for receiving said inner and outer gear rotors therein for urging said outer gear rotor into intermeshing engagement with said inner gear rotor, and wherein said cam ring and said inlet end of the pump are joined together by ultrasonically welding said cam ring to said inlet end for producing a cam ring and inlet end of unitary construction with a seal therebetween.

7. A gear rotor pump comprising: an inner and an outer gear rotor having intermeshing teeth that define circumferentially disposed enlarging and ensmalling pumping chambers, an inlet end of the pump having spaced fluid inlet and outlet ports opening between said rotors into said enlarging and ensmalling chambers, respectively, a cantilever bearing received in said inlet end of the pump, an electric motor having an armature journalled for rotation and rotatably supported at only one end about its axis of rotation by said cantilever bearing and the armature being rotatably unsupported at its other end, said armature being connected with at least one of said gear rotors for rotating them, a hollow drive tube carried by said armature and received over said cantilever bearing, said drive tube being operably connected to said inner gear rotor to rotate said inner gear rotor in unison with said armature, the inner surface of said drive tube being spaced from the outer surface of said cantilever bearing to provide a clearance gap therebetween, and a seal between said drive shaft and said cantilever bearing to prevent contaminants from entering said clearance gap.

8. The gear rotor pump of claim 1 also comprising at least one cavity in said inlet end of the pump for receiving a compressible gas therein for absorbing and dampening pressure fluctuations in liquid fuel adjacent said cavity for reducing pump noise.

9. The gear rotor pump of claim 8 wherein said compressible gas received in said cavity is air.

10. The gear rotor pump of claim 8 wherein said compressible gas received in said cavity is air and vaporized fuel.

11. A gear rotor pump comprising: a housing having an inlet end, an end cap having a locator surface and locator groove for being received in said inlet end of said housing with said locator surface disposed within said housing and said housing received in said locator groove for axially and radially locating said end cap in said housing, a bearing received in said end cap and extending from said cap into said housing, an inner and outer gear rotor having intermeshing teeth that define circumferentially disposed enlarging and ensmalling pumping chambers, said inner gear rotor having a bore therethrough for slidably rotatably receiving said bearing through said bore to provide an axis of rotation for said inner gear rotor and said gear rotors abutting said locator surface of said end cap to axially locate said gear rotors in said housing for improving performance and reducing noise, a motor having an armature journalled for rotation by a shaft extending from said armature and said shaft received in said bearing, and said locator groove having a radial surface about the periphery of said end cap that is substantially perpendicular to the longitudinal axis of said bearing to axially locate said end cap relative to said housing when received in said housing and an axial surface about the periphery of said end cap that is substantially parallel to and concentric with the longitudinal axis of said bearing for engaging against the inner axial surface of said housing to axially locate said end cap and bearing, and said locator surface of said end cap being substantially perpendicular to said longitudinal axis of said bearing for axially locating said gear rotors abutting said locator surface within said housing to improve pump performance while reducing noise.

12. The gear rotor pump assembly of claim 11 wherein said bearing is an elongate cantilever bearing of generally cylindrical, hollow construction for receiving and rotatably supporting said armature shaft and said armature journalled for rotation with said shaft received in said bearing and said bearing rotatably supporting said armature about its axis of rotation at one end while said armature is rotatably unsupported at its other end.

13. The gear rotor pump of claim 12 wherein said cantilever bearing is received in said end cap, and said radial surface of said locator groove and said interior surface are machined in said end cap substantially perpendicular to said longitudinal axis of said cantilever bearing, and said axial surface of said locator groove is machined in said end cap substantially parallel to the longitudinal axis of said cantilever bearing.

14. The gear rotor pump of claim 11 wherein said end cap has spaced fluid inlet and outlet ports axially opening between said rotors into said enlarging and ensmalling chambers, respectively, and also comprising a pressure pulse modulator carried by said end cap and having a bellows cooperating with a spring and in communication with said outlet port to modulate and dampen pressure pulses transmitted by fuel expelled from said ensmalling pumping chambers into said outlet port reducing pump noise.

15. The gear rotor pump of claim 11 wherein said end cap has spaced fluid inlet and outlet ports axially opening between said rotors into said enlarging and ensmalling pumping chambers, respectively, and said end cap having an exterior surface immersed in liquid fuel and at least one cavity in said exterior surface of said end cap with a compressible gas received in said cavity for reducing noise created by the turbulent flow of fuel entering said inlet port.

16. The gear rotor pump of claim 15 wherein said cavity communicates with said outlet port for enabling said compressible gas in said cavity to reduce noise from pressure pulses transmitted by fuel expelled from said ensmalling pumping chambers into said outlet port.

17. The gear rotor pump of claim 11 also comprising a generally cylindrical cam ring for urging said outer gear rotor into intermeshing engagement with the inner gear rotor and said cam ring is ultrasonically welded about its periphery to said interior surface of said end cap.

18. The gear rotor pump of claim 17 also comprising a flange extending axially outwardly from one end of said cam ring and a complementary groove in said interior surface of said end cap for receiving said flange to radially locate said cam ring on said end cap and said flange is ultrasonically welded to said end cap for producing an end cap and cam ring of unitary construction.

19. A method of manufacturing a gear rotor fuel pump comprising: providing a housing having an inlet end, an end cap having a locator surface and a locator shoulder for being received in the inlet end of the housing with the locator surface disposed in the housing and the housing received in the locator shoulder for axially and radially locating the end cap in the housing, a bearing received in the end cap and extending from the end cap into the housing, an inner and outer gear rotor having intermeshing teeth to define circumferentially disposed enlarging and ensmalling pumping chambers, and the inner gear having a bore therethrough for slidably rotatably receiving the bearing through the bore to provide an axis of rotation for the inner gear rotor, and the gear rotors abutting the locator surface of the end cap for axially locating the gear rotors in the housing, an electric motor having an armature journalled for rotation only by a shaft extending from one end of the armature and received in the bearing and the armature being rotatably unsupported at its other end, and (a) machining a bore in the end cap,
(b) inserting the bearing into the bore,
(c) locating the bearing,
(d) machining the interior surface of the end cap substantially perpendicular to the longitudinal axis of the bearing to be a locator surface,
(e) machining the radial surface of the locator shoulder substantially perpendicular to the longitudinal axis of the bearing, and
(f) machining the axial surface of the locator shoulder substantially parallel to the longitudinal axis of the bearing.

20. The method of claim 19 comprising, first, performing step (a), second, performing step (b), third, performing step (c), fourth, performing step (d), fifth, performing step (e), and, thereafter, performing step (f).

21. The method of claim 19 wherein the bearing has an interference fit with the inlet end cap when inserted into the bore.

* * * * *